United States Patent [19]

Gresser

[11] Patent Number: 4,692,264

[45] Date of Patent: Sep. 8, 1987

[54] STABLE, PUMPABLE AQUEOUS ZEOLITE SUSPENSIONS

[75] Inventor: Robert Gresser, Lyon, France

[73] Assignee: Rhone-Poulenc Chimie de Base, Courbevoie, France

[21] Appl. No.: 764,644

[22] Filed: Aug. 12, 1985

[30] Foreign Application Priority Data

Aug. 10, 1984 [FR] France ..... 84 12649

[51] Int. Cl.[4] ..... C11D 3/12

[52] U.S. Cl. ..... 252/140; 252/174.25; 252/179

[58] Field of Search ..... 252/140, 174, 25, 179

[56] References Cited

U.S. PATENT DOCUMENTS

| | | | |
|---|---|---|---|
| 3,463,608 | 8/1969 | Elliott, Jr. | 23/112 |
| 3,790,396 | 2/1974 | Fitton | 106/288 B |
| 3,966,432 | 6/1976 | Rayner | 51/308 |
| 4,072,622 | 2/1978 | Kühling et al. | 252/179 |
| 4,102,977 | 7/1978 | Sugahara et al. | 252/131 |
| 4,179,391 | 12/1979 | Kaufmann et al. | 252/179 |
| 4,368,134 | 1/1986 | Kaeser | 252/140 |

FOREIGN PATENT DOCUMENTS

| | | |
|---|---|---|
| 2095274A | 9/1982 | United Kingdom . |
| 2097419A | 11/1982 | United Kingdom . |

*Primary Examiner*—Robert A. Wax

*Attorney, Agent, or Firm*—Burns, Doane, Swecker & Mathis

[57] ABSTRACT

Aqueous zeolite suspensions, e.g., of type A and especially detergent type 4A, are stabilized and maintained pumpable by adding thereto an effective stabilizing amount of at least one alkaline earth metal cation, advantageously magnesium.

18 Claims, No Drawings

STABLE, PUMPABLE AQUEOUS ZEOLITE SUSPENSIONS

BACKGROUND OF THE INVENTION

1. Field of the Invention

The present invention relates to the production of stable, pumpable aqueous suspensions of zeolite, and in particular synthetic zeolites, and to such stable, pumpable zeolitic suspensions, per se.

2. Description of the Prior Art

It is known to this art to stabilize suspensions of clay. Thus, French Pat. No. 1,334,965 describes producing a suspension of clay by dispersing said clay in water containing a deflocculating agent and a thickening agent. Insofar as the thickening agent is concerned, featured are particular carbohydrates of high molecular weight.

It has also been proposed that amorphous aluminosilicate suspensions may be stabilized in like fashion (U.S. Pat. No. 3,291,626).

French Pat. No. 2,287,504 describes stabilizing suspensions of aluminosilicates by means of a dispersing agent.

To date, various additives have been proposed, the difficulty with which residing in the production of a stable suspension which does not sediment out or which does not sediment out to a substantial extent and which is also pumpable for purposes of introducing same into an atomizable lye slurry.

In order to be suitable for the latter application, the zeolite slurry must have a pH which is at most equal to 11 (expressed at 1% by weight of anhydrous zeolite) and it must have a concentration of anhydrous zeolite preferably ranging from 40 to 50%.

SUMMARY OF THE INVENTION

Accordingly, a major object of the present invention is the provision of an improved zeolite suspension which is both stable and pumpable, as well as being well suited for detergent end uses.

Briefly, the present invention features adding to a zeolite suspension to be stabilized and rendered pumpable, an effective amount, hereinafter deemed an "effective stabilizing amount", of at least one cation of the alkaline earth metal group.

DETAILED DESCRIPTION OF THE INVENTION

More particularly according to the present invention, the amount of cation to be supplied depends upon the other conditions of the suspension, such as pH, concentration of zeolite and also the nature of the cation and the anion.

Typically, for a suspension containing between 20 and 60% of type A zeolite, the content of cation by weight relative to the suspension (or slurry) ranges from 0.002 to 0.5%.

In the description which follows the terms "slurry" and "suspension" are used interchangeably.

Advantageously, the cation concentration is less than that which causes an increase in the viscosity of the slurry.

In all cases, the presence of the cation exerts a positive effect on the quality of the slurry. This effect permits one to avoid the formation of a hard sediment upon storage of the slurry.

Surprisingly, markedly superior results are obtained at pH values ranging from 10 to 11.5.

In a preferred embodiment of the invention, a suspension comprising from 35 to 55%, and preferably from 40 to 50% of zeolite, is adjusted to a pH of from 11 to 11.5 and preferably from 11 to 11.3, and then from 0.002 to 0.5% of the cation, relative to the weight of the slurry, is added thereto, to reduce the pH to a value not greater than 11, while avoiding an increase in the viscosity of said slurry.

According to the invention, the pH is determined for a suspension of 1% by weight of anhydrous zeolite, unless otherwise indicated.

The cation is advantageously introduced in the form of a slat or a hydroxide. Preferably, the cation comprises magnesium.

Consistent herewith, it has been observed that, unexpectedly, the presence of magnesium typically exerted a markedly positive effect on the suspension.

It has been observed that, in particular, excellent results were obtained by adding magnesium chloride to the slurry, either in the form of a concentrated solution thereof, or in powder form. The magnesium chloride is advantageously hexahydrated magnesium chloride.

The zeolite suspension according to the invention is formulated, in particular, from a synthetic zeolite of type A, such as 4A, or of type X, such as 13X, in order to produde a suspension suitable for detergent end uses.

However, the subject suspensions may also be formulated from other types of zeolites, such as type Y.

The zeolite according to the invention may be produced by the process described in French Pat. No. 2,376,074 or French Pat. No. 2,392,932.

However, more preferably a zeolite of type A is used, in particular 4A, which is characterized in that it has the following characteristics:

(i) a mean diameter in respect of the primary particles of from 0.1 to 10 μm and advantageously from 0.5 to 5 μm, (ii) a theoretical cation exchange capacity of higher than 100 mg $CaCO_3$ per gram of anhydrous substance and preferably higher than 200 mg; and (iii) a speed constant $k_s$ related to the surface area of zeolite per liter of solution of higher than 0.15, preferably higher than 0.25 and advantageously ranging from 0.4 to 4 seconds$^{-1}$ liter meter$^{-2}$.

The constant $k_s$ is ascertained as follows:

The expression for the initial exchange speed V is as follows:

$$V = -\frac{d(Ca^{2+})}{dt} = k\,(Ca^{2+})(\text{zeol.}) = k_s(Ca^{2+})S.$$

wherein (zeol.) denotes the concentration of zeolite expressed in terms of ppm of anhydrous zeolite k denotes the second order speed constant expressed in $s^{-1}$ $ppm^{-1}$.

S denotes the surface area of zeolite used per liter of solution, as measured with a scanning microscope and expressed in $m^2l^{-1}$ $k_s$ denotes the speed constant with respect to the surface area of zeolite, per liter of solution, expressed in $s^{-1}l\ m^{-2}$.

It has been determined that unexpected synergistic results are obtained by combining the addition of the magnesium cation with the addition of a certain number of other additives. It is thus possible to influence a number of factors at one time, depending upon the particular end use envisaged.

In particular, the addition of an acid additive may make it possible to reduce the pH.

The process of the invention is especially adopted to produce compositions of the ternary type:

(1) Alkaline earth metal compound
(2) Organic additive
(3) Inorganic additive.

It was thus found that the addition of certain inorganic derivatives, such as phosphates and in particular sodium dihydrogen phosphate ($NaH_2PO_4.2H_2O$) formed additives which made it possible to both improve the rheological properties of the suspension and to operate at an optimum pH level.

In a simple embodiment of the invention, it was observed that it was possible to reduce the pH of the suspension by the action of an acidic agent, such as hydrochloric acid or carbon dioxide.

It was also noted that a similar result could be obtained utilizing such organic derivatives as:

(1) Polyacrylates or polyacrylamides
(2) Copolymers of maleic anhydrides and vinyl ethers
(3) Carboxymethylcelluloses
(4) Polyoxyethylenes.

As hereinbefore mentioned, the invention also features a suspension (or slurry) of zeolite, which is produced as above detailed.

That suspension advantageously has a pH of from 10 to 11.5 and a proportion of dry solids ranging from 35 to 55%.

In addition, it has been determined, in a preferred embodiment of the invention, that a small amount of magnesium does not affect the ion exchange capacity of the zeolite with respect to calcium.

In the case of magnesium chloride, the concentration of magnesium chloride, expressed as $MgCl_2.6H_2O$, advantageously does not exceed 1% by weight with respect to the zeolite slurry.

Such slurries are particularly well suitable for detergent end uses.

In the description to follow, the viscosity of the slurry was ascertained in accordance with the standard DIN 53788-45/8 using a CONTRAVES RM 30 rheometer. The exchange capacity with respect to calcium was determined in a 3 g/l NaCl medium using the method disclosed in French Pat. No. 2,528,722. The initial speed of exchange of the calcium was measured by means of a "forced circulation cell"—A. M. GARY and J. P. SCHWING, *BULL. SOC. CHIM.*, 9, 3654 (1972); A. M. GARY, E. PIEMONT, M. ROYNETTE and J. P. SCHWING, *Anal. Chem.*, 44, 198 (1972); A. M. GARY, *THESE, 3eme CYCLE STRASBOURG*, (1970), for sufficiently high half-reaction times and by terminated flux spectrophotometry for shorter half-reaction times. These two arrangements make it possible to produce sufficiently short mixing times so as not to interfere with kinetic measurement. Thus, after very rapid mixing of the reactants, the process provides for following the variation in concentration of calcium with respect to time, over the course of the exchange reaction, by spectrophotometry in a heterogenous medium employing a calcium indicator: murexide (wavelength of 495 nm).

In order to further illustrate the present invention and the advantages thereof, the following specific examples are given, it being understood that same are intended only as illustrative and in nowise limitative.

EXAMPLE 1

The principal characteristics of the zeolite used in this Example were as follows:

(i) Zeolite 4A (>90%)
(ii) Primary particles having a diameter of 1 to 2 μm
(iii) Free $Na_2O$: 0.66%
(iv) pH-value (1%): 11.5
(v) Exchange capacity: 86 mg Ca/g of anhydrous zeolite (3 g/l NaCl medium)
(vi) $k_s = 0.6 s^{-1} l\ m^{-2}$ The magnesium was added in the form of a concentrated solution of magnesium chloride.

The magnesium concentrations are expressed as a percentage of $MgCl_2.6H_2O$ with respect to the slurry (1% of $MgCl_2.6H_2O$ corresponds, for example, to a proportion by weight of cation in the slurry of 0.12%).

The characteristics of the slurries examined in these Examples were as follows:

TABLE I

| SLURRY | 1 | 2 | 3 | 4 | 5 | 6 | 7 |
|---|---|---|---|---|---|---|---|
| Concentration of slurry (anhydrous zeolite) | 44% | 43.5 | 43% | 43% | 43% | 43% | 42.2% |
| Additive: nature, concentration in the slurry | 0 | $MgCl_2.6H_2O$ 1% | $MgCl_2.6H_2O$ 2% | $MgCl_2.6H_2O$ 2% | $MgCl_2.6H_2O$ 2% | $MgCl_2.6H_2O$ 2% | $MgCl_2.6H_2O$ 2% |
| | | | | GANTREZ ® S 95 1% (*) | Polyacrylamide 0.45% (**) | $NaH_2PO_4.2H_2O$ 1% | $NaH_2PO_4.2H_2O$ 1% Polyacrylic acid 1% (***) |
| pH-value of the slurry (****) | 13.4 | 13.4 | 13.4 | 11.8 | 13 | 11.6 | 11.8 |

(*)GANTREZ ® S 95 was the hydrolyzed form of a copolymer of maleic anhydride and vinyl ether, used in its acid form.
(**)The polyacrylamide had a low molecular mass (M ~ 5000).
(***)The polyacrylic acid had a mean molecular mass of 10,000.
(****)The pH-values specified in this Table were those measured on the undiluted suspension.

The following observations were made:

Suspension 1

The viscosity $\eta$ of the slurry was very high ($\eta > 4{,}000$ mPa.s for a shearing speed $D = 10\ s^{-1}$ and 2,000 mPa.s $< \eta <$ 3,300 mPa.s for $30\ s^{-1} D < 60\ s^{-1}$). The suspension had a slightly "flocculated" appearance, a very fine layer of water was observed at the surface, and sediment was observed at the bottom of the storage flask. Such a suspension was difficult to handle, essentially for reasons of its viscosity.

Suspension 2

The addition of $MgCl_2.6H_2O$ caused a substantial drop in the viscosity of the slurry (1,300 mPa.s$<\eta<$1,800 mPa.s for 30 $s^{-1}<D<60$ $s^{-1}$). After being stored for two days, the fluidity of the slurry was virtually the same, with a slight sediment being observed, which was easy to put back into suspension. After being stored for a week, the slurry had become slightly more viscous and a sediment was observed, which could easily be put back into suspension; no setting was detected after a one month period of time.

Suspension 3

The slurry was fluid (1,000 mPa.s$<\eta<$1,700 mPa.s for 30 $s^{-1}<D<60$ $s^{-1}$) and retained its fluidity for one to two weeks. It was found that a slight sediment was formed, which was easily put back into suspension. No setting was detected after storage for one month.

values which were compatible with detergent uses. The pH-values of the slurries Nos. 4, 6 and 7 as measured on undiluted slurries ranged from 11.6 to 11.8, which corresponded to pH-values (at 1%)<11.

EXAMPLE 2

The zeolite used in this Example had the following characteristics:

(i) Zeolite 4A (>90%)
(ii) Primary particles having a diameter of 1 to 2 μm
(iii) Free $Na_2O$: 0.73%
(iv) pH-value (1%): 11.2
(v) Exchange capacity: 89 mg Ca/g anhydrous zeolite (3 g/l NaCl medium)
(vi) $k_s=0.5s^{-1}l\ m^{-2}$ Unless otherwise indicated, the magnesium chloride was added in the form of a concentrated solution, as in Example 1.

The characteristics of the slurries prepared were as follows:

TABLE II

| SLURRY | 8 | 9 | 10 | 11 | 12 | 13 |
|---|---|---|---|---|---|---|
| Concentration of the slurry (anhydrous zeolite) | 45% | 42.8% | 42.8% | 42.8% | 42.8% | 42.8% |
| Additive: nature, and concentration in the slurry | 0 | $MgCl_2.6H_2O$ 0.1% | $MgCl_2.6H_2O$ 0.25% | $MgCl_2.6H_2O$ 0.5% | $MgCl_2.6H_2O$ 1% | $MgCl_2.6H_2O$ 2% |
| pH-value of the slurry (undiluted) | 12.9 | 12.8 | 12.7 | 12.7 | 12.6 | 12.6 |
| pH-value (1%) | 11.2 | 11 | 10.9 | 10.8 | 10.8 | 10.7 |

Suspension 4

The slurry was highly fluid (700 mPa.s$<\eta<$1,000 mPa.s for 30 $s^{-1}<D<60$ $s^{-1}$), and it was interesting to note that, using a very low speed gradient ($D<5$ $s^{-1}$), the viscosity scarcely exceeded 2,000 mPa.s. This suspension behaved well when stored: after one week, a slight sediment was observed, which was easily put back into suspension. After being stored for one month, the slurry had the same appearance.

Suspension 5

The fluidity of the slurry was good (100 mPa.s$<\eta<$1,600 mPa.s for $305^{-1}<D<60$ $s^{-1}$). Its behavior on being stored was good; a slight sediment was observed at the bottom of the bottle, which was easily put back into suspension, after being stored for one month.

SUSPENSION 6

The slurry was highly fluid (700 mPa.s$<\eta<$1,000 mPa.s for 30 $s^{-1}<D<60$ $s^{-1}$), and it was interesting to note that, using a very low speed gradient ($D-5$ $s^{-1}$), the viscosity scarcely exceeded 2,000 mPa.s. This suspension behaved well upon being stored: after one week, a slight sediment was observed, which was easily put back into suspension. After being stored for one month, the slurry had the same appearance.

Suspension 7

The slurry was highly fluid and no sediment was observed after being stored for one month.

This Example evidences that the slurry was highly viscous, with a high pH-value. Under such conditions, the addition of magnesium had a fluidifying effect on the suspension. The addition of additives further improved fluidity and the behavior of the slurry upon storage, and also made it possible to reduce the pH to The following observations were made:

Suspension 8

The slurry was highly fluid but, after being stored for a few hours, it contained a hard sediment which was very difficult to put back into suspension.

Suspensions 9 and 10

The fluidity of the slurry remained excellent and, after it had been stored for one month, sediment was observed which was easy to put back into suspension; such slurries could be stored for more than one month and were easy to handle.

Suspension 11

The slurry was more viscous but it remained easy to handle. After being stored for one month, a sediment was observed which was easy to put back into suspension.

Suspensions 12 and 13

The suspensions were of a pasty appearance which made them more difficult to handle.

This Example shows that, if the pH of the slurry is not too high, it displays excellent fluidity, but it was found that a hard sediment which was difficult to re-suspend was formed. The addition of a small amount of magnesium preserved the good fluidity of the slurry and permitted storage thereof for more than one month. Above a level of concentration of 0.5% of magnesium expresssed as $MgCl_2.6H_2O$, an increase in the viscosity of the slurry was observed, which gave rise to handling problems.

It was verified that, by increasing the pH of suspension No. 12 (by means of sodium hydroxide pellets in order to maintain the concentration of zeolite at a constant value), up to a value of 13.1 as measured on the undiluted slurry, the fluidity of the slurry was increased: this confirmed the fact that, at a high pH-value, the magnesium had a fluidifying effect (see suspension No. 2). Moreover, it was observed that the fluidity of this slurry was further enhanced by the addition of a small amount of $MgCl_2.6H_2O$.

It will be noted that, under conditions such that the initial pH-value of the slurry is not too high (in the present case, a pH-value at 1% of 11.2), the addition of magnesium made it possible to reduce the pH to values which were compatible with detergent uses (pH-value at 1%<11).

Finally, it was verified that the addition of 0.1% of $MgCl_2.6H_2O$ in powder form to a suspension containing 45% of anhydrous zeolite gave the same result as test No. 9.

EXAMPLE 3

The focus of this Example was to examine the influence of the addition of magnesium to the slurry, on the ion exchange properties of the zeolite. The initial zeolite suspensions used in this Example were the same as those used in Examples 1 and 2. They are respectively denoted as A and B.

The results obtained are reported in the following Table III:

TABLE III

| $MgCl_2.6H_2O$ | pH of the slurry (undiluted) | | Exchange capacity, mg Ca/g anhydrous zeolite | |
|---|---|---|---|---|
| % | Slurry A | Slurry B | Slurry A | Slurry B |
| 0 | 13.4 | 12.9 | 86 ± 7 | 89 ± 7 |
| 0.1 | 13.4 | 12.8 | 61 ± 6 | 94 ± 7 |
| 0.25 | 13.4 | 12.7 | 58 ± 6 | 95 ± 7 |
| 0.5 | 13.4 | 12.7 | 54 ± 6 | 84 ± 7 |
| 1 | 13.4 | 12.6 | 58 ± 6 | 89 ± 7 |
| 2 | 13.4 | 12.6 | 51 ± 6 | 86 ± 7 |

These results show that, if the pH of the slurry is high, the addition of magnesium reduces the capacity for exchange of the calcium by the zeolite. If the initial pH of the slurry is not too high (in the case pH-value=12.9, which corresponds to a pH-value at 1% of 11.2), the addition of magnesium does not affect the exchange capacity of the zeolite.

It was also verified that the addition to the zeolite slurry of a concentration of $MgCl_2.6H_2O$ of less than 1% did not affect the value of $k_s$.

EXAMPLE 4

The focus of this Example was to examine the influence of the addition of $MgCl_2.6H_2O$ to a zeolite slurry whose initial pH (expressed at 1% by weight of anhydrous zeolite) was lower than 11. The characteristics of the zeolite used were as follows:

(i) Zeolite 4A (>90%)
(ii) Primary particles having a diameter of 1 to 2 μm
(iii) Free $Na_2O$: 0.40%
(iv) pH-value (1%): 10.4
(v) Exchange capacity: 100 mg Ca/g of anhydrous zeolite (3 g/l NaCl medium)
(vi) $k_s=0.6s^{-1}l\ m^{-2}$ The characteristics of the slurries examined in this Example were as follows:

| SLURRY | 1 | 2 |
|---|---|---|
| Concentration of the slurry (anhydrous zeolite) | 48% | 48% |
| Additive: nature and concentration in the slurry | 0 | $MgCl_2.6H_2O$ 0.1% |
| pH-value (1%) | 10.4 | 10.4 |

The following observations were made:

Slurry 1

The slurry was fluid but, after being stored for a few hours, it contained a hard sediment which was very difficult to re-suspend.

Slurry 2

The viscosity of the slurry increased slightly and, after being stored for one week, aslight sediment was observed which could easily be put back into suspension. Such a slurry could be handled under good conditions.

This example shows that the addition of $MgCl_2.6H_2O$ to a zeolite slurry whose pH (at 1%) was 10.4 permitted it to be stored for more than one week and enabled it to be handled under good conditions.

EXAMPLE 5

The focus of this Example was to examine the influence of a reduction in the pH of a slurry containing magnesium, on its stability and its behavior under storage. The characteristics of the zeolite used were as follows:

(i) Zeolite 4A (>90%)
(ii) Primary particles having a diameter of 1 to 2 μm
(iii) Free $Na_2O$: 0.73%
(iv) pH-value (1%): 11.2
(v) Exchange capacity: 89 mg Ca/g of anhydrous zeolite (3 g/l NaCl medium)
(vi) $k_s=0.5s^{-1}l\ m^{-2}$.

The drop in the pH was caused by the addition of concentrated hydrochloric acid, and the characteristics of the slurries examined were as follows:

| SLURRY | 3 | 4 |
|---|---|---|
| Concentration of the slurry (anhydrous zeolite) | 42.8% | 42.8% |
| Additive: nature and concentration in the slurry | $MgCl_2.6H_2O$ 0.1% | $MgCl_2.6H_2O$ 0.1% |
| pH-value (1%) | 10.9 | 10.4 |

The following observations were made:

Slurry 3

The slurry was fluid and, after being stored for one month, a sediment was observed which was easy to put back into suspension. Such a slurry could be stored for more than one month and could be handled under good conditions.

Slurry 4

No increase in the viscosity of the slurry was observed, and its stability upon being stored was comparable to that of Slurry No. 3.

This Example evidences that a reduction in the pH of a zeolite slurry stabilized with magnesium chloride does not modify its behavior upon being stored.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A composition of matter which comprises a stable, pumpable aqueous suspension of a zeolite having a pH ranging from about 10 to about 11.5, said zeolite suspension comprising stabilizing material in an amount effective to prevent sedimentation upon storage, said stabilizing material consisting essentially of alkaline earth metal cations wherein said alkaline earth metal cations alone are suitable for the stabilization of the zeolite suspension.

2. The composition of matter as defined by claim 1, comprising from 20 to 60% by weight of said zeolite and from 0.002 to 0.5% by weight of said alkaline earth metal cations.

3. The composition of matter as defined by claim 2, comprising from 35 to 55% by weight of said zeolite and having a pH ranging from 11 to 11.5.

4. The composition of matter as defined by claim 2, said zeolite suspension comprising magnesium in an amount effective to prevent sedimentation upon storage.

5. The composition of matter as defined by claim 4, said zeolite suspension comprising a magnesium chloride additive.

6. The composition of matter as defined by claim 5, said zeolite suspension comprising a maximum of 1% by weight of magnesium chloride, expressed as $MgCl_2.6H_2O$.

7. The composition of matter as defined by claim 2, said zeolite suspension comprising a type A zeolite.

8. The composition of matter as defined by claim 7, said zeolite suspension comprising a type 4A zeolite.

9. The composition of matter as defined by claim 2, said zeolite suspension comprising a type X zeolite.

10. The composition of matter as defined by claim 2, said zeolite suspension comprising a type Y zeolite.

11. The composition of matter as defined by claim 8, said 4A zeolite having (i) a mean primary particle diameter of from 0.1 to 10 $\mu$m, (ii) a theoretical cation exchange capacity in excess of 100 mg of $CaCO_3$ per gram of anhydrous material, and (iii) a speed constant $k_s$ related to the surface area of zeolite per liter of suspension in excess of 0.15 seconds$^{-1}$ liter meter$^{-2}$.

12. The composition of matter as defined by claim 2, further comprising at least one pH adjusting additive.

13. The composition of matter as defined by claim 2, further comprising at least one detergent additive.

14. The composition of matter as defined by claim 2, further comprising at least one pH and rheology adjusting additive selected from the group consisting of a phosphate or an acidic agent.

15. A detergent composition comprising a surfactant and the stable zeolite suspension as defined by claim 1.

16. A process for stabilizing and rendering pumpable an aqueous suspension of zeolitic material, comprising adding to the zeolite suspension stabilizing material in an amount effective to prevent sedimentation upon storage and to produce a pumpable aqueous suspension of zeolite having a pH ranging from about 10 to about 11.5, said stabilizing material consisting essentially of alkaline earth metal cations wherein said alkaline earth metal cations alone are suitable for the stabilization of the zeolite suspension.

17. The process as defined by claim 16, further comprising adjusting the pH of said zeolite suspension in the absence of an increase in the viscosity thereof.

18. The composition of matter as defined by claim 2, further comprising an organic polymer selected from the group consisting of polyacrylates, polyacrylamides, copolymers of maleic anhydrides and vinyl ethers, carboxymethylcelluloses, polyoxyethylenes and mixtures thereof.

* * * * *